United States Patent [19]

Watson

[11] Patent Number: 4,659,049

[45] Date of Patent: Apr. 21, 1987

[54] KNOCK-DOWN OUTDOOR COASTER

[76] Inventor: Nigel S. Watson, 655 San Pablo Ave., Apt. 3, Rodeo, Calif. 94572

[21] Appl. No.: 800,423

[22] Filed: Nov. 21, 1985

[51] Int. Cl.[4] ..... A47B 91/00

[52] U.S. Cl. ..... 248/346.1; 248/156

[58] Field of Search ..... 248/346.1, 346, 156, 248/530, 87, 188.9, 545, 508

[56] References Cited

U.S. PATENT DOCUMENTS

| | | | |
|---|---|---|---|
| 1,981,627 | 11/1934 | Merriman | 248/346.1 |
| 2,954,194 | 9/1960 | Alfano | 248/156 X |
| 3,762,591 | 10/1973 | Gray | 248/346.1 X |
| 4,065,085 | 12/1977 | Gellatly | 248/156 X |
| 4,076,198 | 2/1978 | Garrett | 248/156 X |
| 4,079,908 | 3/1978 | Davis | 248/156 |
| 4,433,823 | 2/1984 | Pearson | 248/346.1 |

*Primary Examiner*—Ramon O. Ramirez

*Attorney, Agent, or Firm*—Harris Zimmerman; Howard Cohen

[57] ABSTRACT

A device for supporting drinking glasses or other small objects out of contact with beach sand or the earth at other outdoor locations has a ground engaging spike with a pointed lower end and a relatively broad upper end on which a plate member is disposed in a transverse and substantially centered relationship with the spike. Retainer structure holds the plate on the spike during use while enabling separation of the plate and spike when not in use. In a preferred form, the spike is itself formed of separable flat elements. The device may be easily disassembled and the components may be rearranged into a very compact configuration when the device is being carried between locations or being stored.

8 Claims, 7 Drawing Figures

KNOCK-DOWN OUTDOOR COASTER

TECHNICAL FIELD

This invention relates to coasters for supporting drinking glasses, beverage containers or the like. More particularly, the invention relates to devices of that type designed for use at beaches or at other outdoor areas where the coaster may be situated over loose sand or irregular and/or sloping terrain.

BACKGROUND OF THE INVENTION

Persons who visit beaches, picnic sites or other outdoor areas often encounter problems when drinking glasses or the like are rested on the ground. Beach sand is usually a loose material that does not provide a stable support base. The beach surface may be uneven and/or unlevel. Particles of sand may adhere to the drinking glass. Similar problems may occur at least to some extent at other types of outdoor area where drinking glasses or the like are rested on the ground.

A conventional coaster may prevent adherence of sand to a drinking glass under some conditions but does not resolve the problems caused by a loose, uneven or inclined ground surface. The conventional coaster is subject to essentially the same problems as the drinking glass itself as it rests on the ground.

In many instances it is impractical or at least inconvenient to bring a bulky table to a beach or other outdoor area. Somewhat smaller devices have been designed for supporting beverage containers above the ground but, as heretofore constructed, are still undesirably bulky and inconvenient to carry. Prior devices for that purpose also tend to have an undesirably costly construction.

Ideally, a device for the above described purpose should be capable of being carried in a pocket, purse or other container without occupying much space. Usage would also be facilitated if the devices were light in weight and of low unit cost.

The present invention is directed to overcoming one or more of the problems discussed above.

SUMMARY OF THE INVENTION

In one aspect, the present invention provides an outdoor coaster for supporting drink containers or the like above the surface of the ground having a ground engaging spike with a substantially pointed lower end and a relatively broad upper end, a plate member disposed on the broad upper end of the ground engaging spike in a transverse and substantially centered relationship with the spike and retainer means for holding the plate member on the ground engaging spike in the transverse substantially centered relationship while enabling selective separation of the plate member from the ground engaging spike.

In another more specific aspect, the invention provides an outdoor coaster for supporting drink containers or the like above the surface of the ground that includes a ground engaging spike having separable first and second flat elements each of which has a substantially pointed lower end and a relatively broad upper edge, the flat elements being positioned substantially at right angles to each other with the broad upper edges in cruciform relationship. A substantially flat plate member is disposed against the upper edges of the flat elements in a transverse and substantially centered relationship to the ground engaging spike and retainer means are provided for holding the plate member in the transverse and substantially centered relationship while enabling selective separation of the plate member from the ground engaging spike.

The ground engaging spike of the outdoor coaster may be inserted into beach sand or other loose or soft earth to provide a stable, level and secure support base for drinking glasses or other small objects that are rested on the transverse plate member. Components of the coaster may be separated and be rearranged into a very compact configuration when the device is being carried between locations or being stored. In a preferred form of the invention, the ground engaging spike is itself defined by separable components which are flat and made of low cost light weight material.

DETAILED DESCRIPTION OF THE PREFERRED EMBODIMENT

Figure 1:
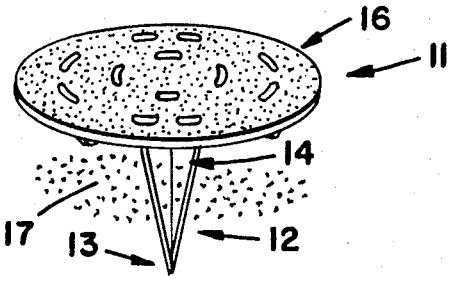
FIG. 1 is a perspective view of an outdoor coaster in accordance with a preferred embodiment of the invention.

Referring initially to FIG. 1 of the drawing, an outdoor coaster 11 in accordance with this embodiment of the invention includes a ground engaging spike 12 having a pointed lower end 13 and a relatively broad upper end portion 14. A flat transverse plate member 16 is disposed on the upper end portion 14 in centered relationship over the spike 12 to define a platform on which a drinking glass, beverage container or other objects (not shown) can be rested. If desired, the upper surface of the plate member can be roughened, as indicated in FIG. 1 in order to reduce sliding movement of a glass positioned on the surface. In use, the spike 12 is forced downwardly into beach sand 17 or other loose or soft earth for a distance sufficient to assure that the plate member 16 is securely held in a fixed, level orientation.

Figure 2:
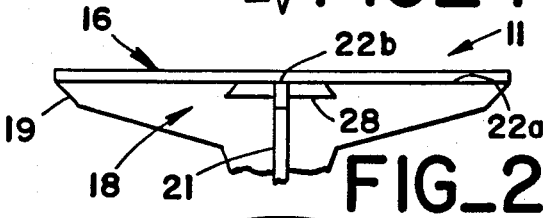
FIG. 2 is a side view of the upper portions of the outdoor coaster of FIG. 1.

Referring now to FIG. 2, retainer means 18 are provided to hold the plate member in the above described position on spike 12 while enabling selective separation of the plate member from the spike, the retainer means being hereinafter described in more detail. In the preferred embodiment, the spike 12 is itself formed by separatable flat elements 19 and 21. Carrying and storage of the outdoor coaster 11 is greatly facilitated by the construction to be hereinafter described which enables easy disassembly of the device into a number of separate components and easy reassembly when the device is to be put into use. The plate member 16 and spike elements 19 and 21 occupy substantially less space in the disassembled condition. Small units of the coaster 11 suitable for supporting a single drinking glass or the like can readily be carried in a pocket, purse or other container without occupying an inconvenient amount of space. The relative compactness of the coaster 11 in the disassembled condition also provides economies in the distribution of the coasters 11 from he manufacturer to the consumer. Shipping costs are reduced, less storage space is needed and more economical packaging may be used.

Figure 3:
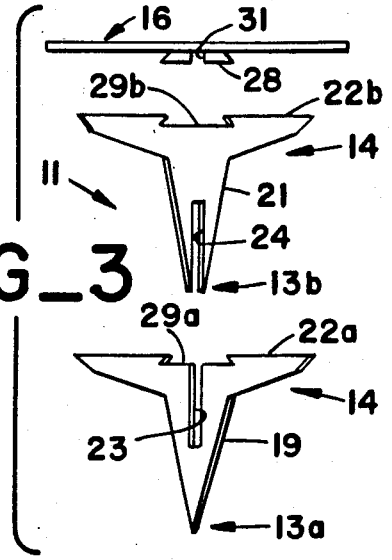
FIG. 3 is an elevation view of the components of the outdoor coaster of FIG. 2 shown separated from each other.

Considering the construction of the coaster 11 in more detail and with reference to FIG. 3, the flat spike elements 19 and 21 each have broad upper edges 22*a* and 22*b* respectively and become progressively narrower towards the lower ends 13*a* and 13*b* of the elements. The degree of taper is preferably more abrupt at the upper end portions 14 of the spike elements 19 and 21 than the degree of taper below those portions in order to reduce resistance when the spike 12 is being forced into sand or the like.

One of the spike elements 19 has a vertical slot 23 extending downward a distance from the center of the upper edge 22*a* of the element and another vertical slot 24 extends a distance upwardly from the lower end 13*b* of the other spike element 21. Slots 23 and 24 are of equal length or otherwise compatibly proportioned to enable assembly of the spike elements 19 and 21 in the manner depicted in FIG. 4. In particular, with reference to FIGS. 3 and 4 in conjunction, the spike elements are assembled by being oriented at right angles to each other after which the upper portion of element 19 is fitted into slot 24 of element 21 while the lower portion of element 21 fits into slot 23 of element 19.

The cruciform configuration of the assembled spike 12 enhances stability of the coaster 11 during use by maximizing resistance to turning or tilting movements when the device has been implanted in soft sand or the like. A conical spike of similar dimensions is distinctly less stable in these respects.

Figure 5:
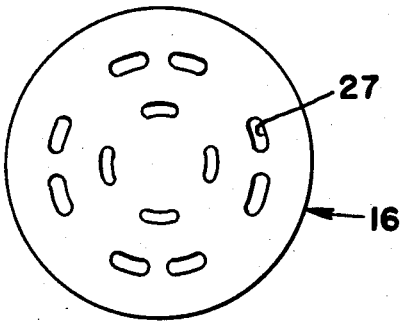
FIG. 5 is a plan view of the coaster of the preceding figures.
Figure 4:
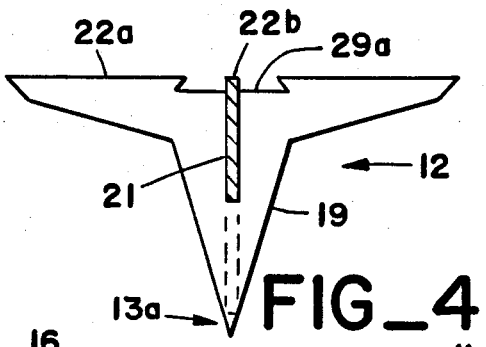
FIG. 4 is a side cross-sectional view through the center of the ground engaging spike of the coaster of the preceding figures.

Referring to FIGS. 3, 4 and 5, the plate member 16 in this embodiment is circular and has a diameter equal to the length of the upper edges 22*a*, 22*b* of spike elements 19 and 21 although the plate member may have other configurations if desired. Spaced apart openings 27 may be provided in the plate member 16 to drain condensation from iced drinks, ocean spray, rainwater or other fluids which might otherwise accumulate on the upper surface of the plate member.

The retainer means 18 includes a circular boss 28 at the center of the underside of plate member 16, the boss being of progressively increasing diameter in the downward direction. Spike elements 19 and 21 each have a notch 29*a* and 29*b* respectively at the center of the upper edges 22*a* and 22*b* respectively of such elements. The notches 29*a*, 29*b* have a length equal to the maximum diameter of boss 28 and are acutely angled at their ends to conform with the profile of the boss. Two diametrical grooves 31, oriented at right angles to each other, are formed in the boss 28.

Figure 6:
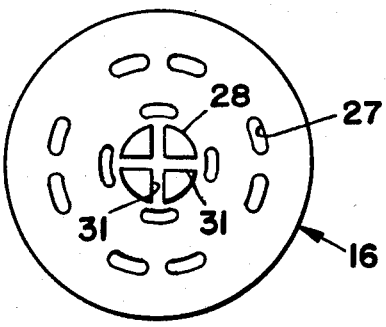
FIG. 6 depicts the underside of the plate component of the outdoor coaster of the preceding figures.
Figure 7:
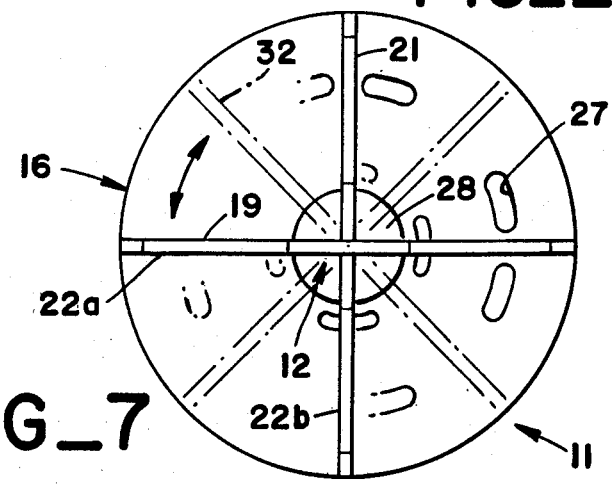
FIG. 7 is a bottom view of the assembled outdoor coaster and illustrates a latching action which retains the components together when the device is in use.

Referring to FIGS. 2, 6 and 7, the plate member 16 and spike 12 are engaged with each other prior to use by initially turning one or the other of such elements to bring the upper edges 22*a* and 22*b* of spike elements 19 and 21 into alignment with the crossed grooves 31 of boss 28. The plate member 16 may then be placed in contact with the upper edges 22*a* and 22*b* of the spike elements 19 and 21 without interference from the inwardly angled ends of notches 29*a* and 29*b*. The plate member 16 and spike 12 are then latched together by turning one such component relative to the other to an angular position, such as that depicted by dashed lines 32 in FIG. 7, at which the spike elements 19 and 21 are no longer in alignment with the grooves 31 of boss 28. The acutely angled ends of notches 29*a* and 29*b* then grip the boss 28 to hold the plate member 16 on the spike 12. The spike elements 19 and 21 are also effectively latched together as boss 28 blocks vertical movement of one such element relative to the other.

The coaster 11 is easily disassembled following usage by reversing the above described assembly operations. Turning either that plate member 16 or spike 12 back to the angular orientation at which edges 22*a* and 22*b* are aligned with grooves 31 enables separation of the plate member and spike. Spike elements 19 and 21 may then be separated by withdrawing one longitudinally from the other.

The separated components 16, 19 and 21 collectively occupy much less space than is required for the assembled coaster 11 and can be conveniently carried and stored in the manner hereinbefore described until such time as the coaster is reassembled for repeated usage.

The coaster 11 can advantageously be formed of plastic as this provides a desirably light and low cost construction. Other materials such as metal or wood may also be employed to form some or all of the components. A coaster 11 measuring about 10 cm in diameter and having a height of about 6 cm accomodates most drinking glasses or canned or bottled beverage containers, provides adequately stable support in most beach sands and breaks down into separate components that can easily be fitted in large pockets on garments or purses or the like. The dimensions may of course be varied as desired to accomodate to other conditions of usage.

While the invention has been described with respect to one specific embodiment, many variations in the structure are possible and it is not intended to limit the invention except as defined in the following claims.

I claim:

1. In an outdoor coaster for supporting containers or the like above the surface of the ground, the combination comprising:

a ground engaging spike having a substantially pointed lower end and a relatively broad upper end, a plate member disposed on said broad upper end of said ground engaging spike in a transverse and substantially centered relationship therewith, and retainer means for holding said plate member on said ground engaging spike in said transverse substantially centered relationship therewith while enabling selective separation of said plate member from said ground engaging spike, said ground engaging spike including first and second flat spike elements each having a substantially pointed lower end and a relatively broad upper edge, a first of said spike elements having a slot extending downward from said upper edge thereof and the second of said spike elements having a slot extending upward from said lower end thereof, said first and second spike elements intersecting with an upper portion of said second element being fitted within said slot of said first element and a lower portion of said first element being fitted within said slot of said second element.

2. The outdoor coaster of claim 1 wherein said upper edges of said first and second spike elements are co-planar and said retainer means holds said plate member against said edges.

3. An outdoor coaster for supporting drink containers or the like above the surface of the ground comprising:

a ground engaging spike having separable first and second flat elements each of which has a substantially pointed lower end and a relatively broad upper edge, said flat elements being positioned substantially at right angles to each other with said broad upper edges being in cruciform relationship, a substantially flat plate member disposed against said upper edges of said flat elements in a transverse and centered relationship to said ground engaging spike, and retainer means for holding said plate member in said transverse and substantially centered relationship on said ground engaging spike while enabling selective separation of said plate member therefrom.

4. The outdoor coaster of claim 3 wherein said first and second flat elements each have a notch at the central regions of said upper edges, the upper portions of said notches being of less length than the lower portions thereof, and wherein said retainer means includes a circular boss at the center of the underside of said plate member which boss has grooves which extend radially inwardly from the periphery of the boss at ninety degree intervals therearound, said boss being fitted into said notches and having a profile conforming to the configuration of said notches, said plate member being turnable relative to said ground engaging spike between an angular orientation at which said notches and grooves are aligned and another orientation at which said notches and grooves are out of alignment.

5. In an outdoor coaster for supporting drink containers or the like above the surface of the ground, the combination comprising:

a ground engaging spike having a substantially pointed lower end and a relatively broad upper end, a plate member disposed on said broad upper end of said ground engaging spike in a transverse and substantially centered relationship therewith, retainer means for holding said plate member on said ground engaging spike in said transverse substantially centered relationship therewith while enabling selective separation of said plate member from said ground engaging spike, said ground engaging spike including first and second intersecting flat spike elements each having a substantially pointed lower end and a relatively broad upper edge, each of said spike elements having a notch at the central region of said upper edge which notch has acutely angled ends; and wherein said retainer means includes a circular boss on the underside of the central region of said plate member that is of increasing diameter in the downward direction to provide said boss with a profile conforming to the configuration of said notches, said boss being fitted into said notches of said spike elements.

6. The outdoor coaster of claim 5 wherein said boss is provided with radially directed grooves which extend at least a distance inwardly from the periphery of said boss at angular intervals around said periphery, said grooves being positioned to receive said acutely angled ends of said notches when said plate member has a predetermined angular orientation relative to said ground engaging spike.

7. The outdoor coaster of claim 6 wherein said first and second flat spike elements are oriented substantially at right angles to each other and said grooves are located substantially at ninety degree angular intervals around said periphery of said boss.

8. In an outdoor coaster for supporting drink containers or the like above the surface of the ground, the combination comprising:

a ground engaging spike having a substantially pointed lower end and a relatively broad upper end, a plate member disposed on said broad upper end of said ground engaging spike in a transverse and substantially centered relationship therewith, retainer means for holding said plate member on said ground engaging spike in said transverse substantially centered relationship therewith while enabling selective separation of said plate member from said ground engaging spike, said ground engaging spike including first and second intersecting flat spike elements each having a broad upper edge adjacent said plate member and each of which tapers towards a substantially pointed lower end of said spike centered below said plate member, the spike elements being more abruptly tapered at the upper portions thereof than at the lower portions thereof.

* * * * *